United States Patent [19]

Bordini et al.

[11] Patent Number: 5,024,584

[45] Date of Patent: Jun. 18, 1991

[54] PUMP UNIT WITH ADJUSTABLE PISTON STROKE LENGTH

[75] Inventors: Giorgio Bordini; Maurizio Vincenzi, both of Modena, Italy

[73] Assignee: Tetra Dev-Co, Modena, Italy

[21] Appl. No.: 277,870

[22] Filed: Nov. 30, 1988

[30] Foreign Application Priority Data

Nov. 30, 1987 [IT] Italy ..... 22816 A/87

[51] Int. Cl.[5] ..... F04B 15/02; F04B 1/28

[52] U.S. Cl. ..... 417/342; 417/347; 417/900

[58] Field of Search ..... 417/454, 342, 517, 519, 417/532, 900, 344–347

[56] References Cited

U.S. PATENT DOCUMENTS

| | | | |
|---|---|---|---|
| Re. 26,820 | 3/1970 | Bennett | 417/342 |
| 1,767,404 | 6/1930 | Schaer | 417/342 |
| 2,807,215 | 9/1957 | Hawxhurst | 417/394 |
| 3,516,761 | 6/1970 | Scroggins | 417/345 |
| 3,718,409 | 2/1973 | Brandenberg et al. | 417/342 |
| 4,646,868 | 3/1987 | Rosell | 92/98 D |
| 4,759,695 | 7/1988 | Bordini | 417/519 |
| 4,773,305 | 9/1988 | Nissels | 92/98 D |

FOREIGN PATENT DOCUMENTS

| | | | |
|---|---|---|---|
| 574566 | 4/1959 | Canada | 417/342 |

*Primary Examiner*—Leonard E. Smith
*Assistant Examiner*—Eugene L. Szczecina, Jr.
*Attorney, Agent, or Firm*—Burns, Doane, Swecker & Mathis

[57] ABSTRACT

A pump unit comprising co-operating, push-pull connected reciprocating pumps for the pumping in portions of contents to packing containers on a packing machine. The reciprocating pumps (1) each comprise a control piston (4) connected to the pump piston (6) in control cylinders (18), which are joined together in pairs by means of a connecting pipe (20). The pipe is provided with a flow regulating valve (21) for regulating the flow rate of the hydraulic oil and hence the piston speed. The quantity of hydraulic oil in the connecting pipe can be regulated with the help of a supply tank (23) so that the length of stroke of the pistons can be adjusted.

7 Claims, 2 Drawing Sheets

PUMP UNIT WITH ADJUSTABLE PISTON STROKE LENGTH

The present invention relates to a pump unit comprising co-operating, push-pull connected reciprocating pumps which can be joined to a common inlet or outlet.

In the branch of the packaging industry concerned with the manufacture, filling and closing of individual packing containers e.g. of the non-returnable type with pumpable contents, a metering pump frequently is used in order to obtain correct quantities of contents in each packing container. The metering pump usually is a reciprocating pump, since this type of pump makes it possible in continuous operation of the packing machine to fill a predetermined quantity of contents repeatedly and with great acuracy of volume into each packing container. It is necessary of course to design the arrangement in such a manner that an adjustment of the volume of contents pumped at each stroke can be brought about. This adjustment is done in that the length of stroke of the pump piston is regulated. When the reciprocating pump is driven, as is commonly the case, from a cam synchronized with the movement of the packing machine, the adjustment of the length of stroke takes place with the help of mechanical regulating devices on the arms or links which transfer the driving power from the cam to the pump piston. This means in practice that an adjustment can take place only when the machine is at standstill, since otherwise the mechanical design would become very complicated and bring about increased risk of wear damages and play which adversely affect the volume accuracy of the pump.

The adaptation of the pump to different types of contents and different package sizes makes necessary not only a facility of adjusting the length of stroke of the pump but also its speed. The piston speed can be adjusted in the types of metering pumps known up to now only in that the cam driving the pump is exchanged by one with the desired characteristic. This means an extensive intervention into the construction of the packing machine, and in practice therefore the speed of the pump is considered as non-adjustable. On filling packing containers which are of a size less than that maximum possible in the particular packing machine, the quantity of contents will be portioned out, therefore, only during a limited part of the time available for filling of each packing container, which causes the flow of contents to be more rapid than necessary, with the consequent danger of viscosity changes in sensitive contents, frothing on discharge into the packing container etc.

In high-capacity packing machines a doubled metering pump is frequently used, moreover, e.g. in the form of two separate but jointly driven reciprocating pumps, which make it possible to even out pressure variations in the flow of contents and to secure a pumping which handles the contents more gently. Such a design is particularly suitable on packing machines with two filling stations, and the arrangement may also be used, of course, for filling two different types of contents into the same packing container, e.g. yoghurt and fruit.

The known designs of metering reciprocating pumps used on packing machines thus cannot without appreciable technical complications be furnished with the adjustability which is desirable so as to make possible the filling of contents having varying properties where e.g. viscosity, presence of particles, tendency to frothing or the like are concerned. In the known designs the adapting of the characteristics of the pump to the filling of packing containers of varying sizes too is complicated, and it is altogether impossible in practice to carry out during operation the regulation of the pumped volume or the speed of the pump.

It is an object of the present invention to provide a pump unit which is not subject to the abovementioned disadvantages but has great flexibility and is of such a design that a far-reaching adaptation of the characteristics of the pump is simple to carry out on a change of the type of contents or of the size of package.

It is a further object of the present invention to provide a pump unit which works with lasting accuracy also during long periods of operation.

It is a further object of the present invention to provide a pump unit which is of simple design and requires little service.

These and other objects have been achieved in accordance with the invention in that a pump unit comprising co-operating, push-pull connected reciprocating pumps which can be joined to a common inlet or outlet is given the characteristic that the reciprocating pumps each comprise a piston driven by means of pressure fluid, these pistons being joined together in pairs by means of a synchronizing arrangement which via a hydrualic connecting pipe connects to one another control cyclinders, one provided for each piston, whose volume varies proportionally to the piston movement.

Preferred embodiments of the pump unit in accordance with the invention have been given, moreover, the characteristics which are evident from the subsidiary claims.

By using in accordance with the invention a double piston pump whose pistons are hydraulically connected with one another and are driven by means of pressure fluid, a pump unit is obtained which furnishes a quiet and uniform flow of contents and which wholly lacks mechanical connecting elements, thus providing great flexibility and high operational reliability. The pumping speed and the stroke volume, moreover, can be adjusted in a simple manner also during operation, which renders the pump unit particularly suitable for use together with modern packing machines of the type which continuously monitor and adjust the quantity of contents.

The arrangement in accordance with the invention will now be described in more detail with special reference to the attached drawing which schematically shows a preferred embodiment of the pump unit in accordance with the invention, only the details indispensable for an understanding of the invention having been included.

Figure 1:
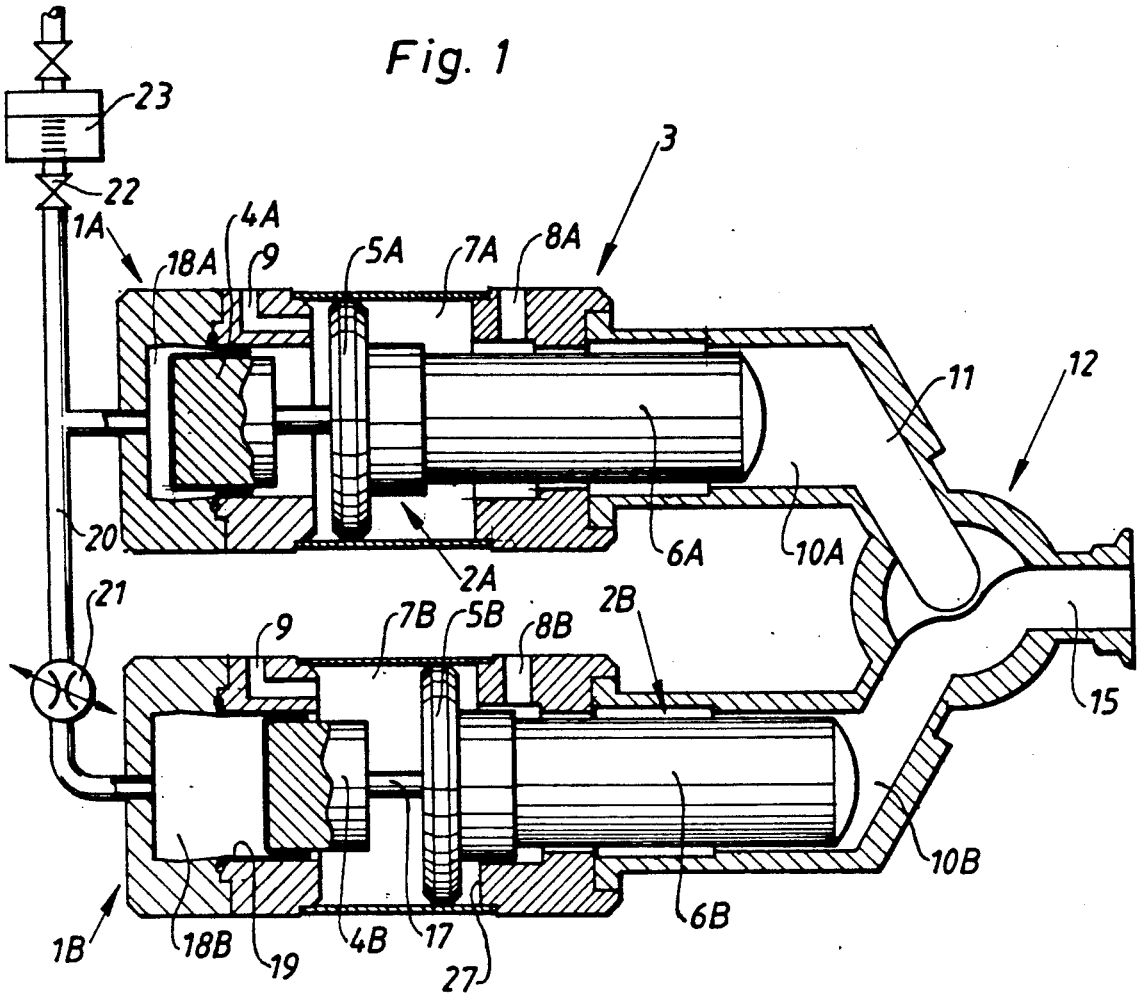
FIG. 1 shows the unit in accordance with the invention in section.

The pump unit in accordance with the invention, which comprises two co-operating reciprocating pumps 1 (A, B), is intended above all to be used on a packing machine of the known type which fills contents in portions into preformed packing container blanks or a tube of packing material which subsequently is converted to closed packing containers. The pump unit, furthermore, is particularly suitable for use on packing machines of the type which monitor the quantity of contents in each individual packing container and during operation continuously make corrections of the volume of contents pumped to each succeeding packing container. Notwithstanding the above, the pump unit in accordance with the invention may be used, of course, on other types of machines or for pumping within other fields of application where the special advantages of the pump might come into their own.

The two reciprocating pumps 1A and 1B which form part of the pump unit in accordance with the invention are identical in principle, and it should be sufficient, therefore, to describe one reciprocating pump in detail. The said reciprocating pump 1 thus comprises a piston 2 which is axially movable to and fro in a pump casing 3. The piston is composed of three individual piston parts with different functions, namely a control piston 4, a drive piston 5 and a pump piston 6. The drive piston 5 is located centrally between the two other pistons 4, 6 and is surrounded by a part of the pump casing 3 designed as a drive cylinder 7. The drive cylinder 7 is single-acting and is provided with an air inlet 8 and an air outlet 9, which are in connection with the drive cylinder 7 on either side of the drive piston 5. The air inlet 8 is able to be connected to a compressed air source of known design (not shown).

The drive piston 5 on its side facing the air inlet 8 is connected directly to the pump piston 6, which is located in a pump cylinder 10 which via a contents duct 11 is connected to a contents valve 12. The valve 12, which comprises a rotating conical valve body 14 located inside a valve casing 13, can be manoeuvred so as to connect the pump cylinder 10 alternately to an inlet 15 for contents and to an outlet 16. The design of the valve 12 will be described in more detail in the following.

On the side of the drive piston 5 remote from the pump piston 6 the drive piston 5 has a piston rod 17 which on its other end is connected to the control piston 4. The control piston 4 is located in a control cylinder 18 which is sealed in respect of the space on the piston rod side of the control piston 4 by means of a roller diaphragm 19 which in a liquid-tight manner connects the control piston 4 to the inner wall surface of the control cylinder 18.

The control cylinders 18 of the two reciprocating pumps 1A and 1B are mutually joined by means of a connecting pipe 20 which comprises a flow regulating valve 21. The connecting pipe 20 is also connected via a valve 22 to a supply tank 23 for oil. This supply tank can be pressurized with the help of known means, not shown. At the opposite end of the reciprocating pumps 1A, 1B in relation to the connecting pipe 20 the two pump cylinders 10, as mentioned earlier, are connected via the contents ducts 11 to the common contents valve 12. As is evident, especially from FIG. 2, the valve body 14 of the contents valve is connected via a valve spindle 24 on the one hand to a, for example, pneumatic manoeuvring device 25 for rotating the valve body 14 to and fro by ⅓rd turn, on the other hand to a driving device 26 for the axial displacement of the valve body 14 so that the conical part of the same is moved from the working position shown in FIG. 2 to a cleaning position, where the conical part of the valve body 14 is at a distance from the corresponding internally tapering part of the valve casing 13. The two manoeuvring devices 25, 26 are of a conventional type and are not, therefore, described in detail.

As is evident from FIG. 1, the two pistons 2A and 2B are coupled together in push-pull connection with the help of the connecting pipe 20, that is to say the one piston reaches its one reversal position at the same time as the other piston reaches its opposite end position. The piston 2 which at the time moves in a working stroke (that is to say directed to the right in FIG. 1) hereby determines the reversal position in that the front surface of the drive piston 5 seen in the direction of movement will come to rest against a piston stop 27 provided at the end wall of the drive cylinder 7 which defines the one end position of the piston. Indirectly the opposite end position is also defined by the same piston stop, since the pistons are always so joined to one another via the connecting pipe 20 in that they move synchronously but in opposite directions. Thus, when the piston stop 27 limits the working stroke of the one piston it will also limit the return stroke of the other piston via the hydraulic connection and a corresponding mechanical piston stop for a direct limitation of the return stroke is therefore not provided.

For the pumping of contents from a common source of contents (not shown), for example, to a packing machine the unit is driven with the help of compressed air which is conducted from a source of compressed air, known in itself, by means of a control device not shown (e.g. by means of a conventional three-way valve) alternately to the two air inlets 8A and 8B respectively. When e.g. the air inlet 8A is joined up to the source of compressed air, the compressed air will flow into the drive cylinder 7 and more particularly into the part of the drive cylinder which is situated to the right of the drive piston 5A (FIG. 1, upper part). The drive piston 5A will be displaced hereby in the opposite direction, that is to say towards the left in FIG. 1, whilst at the same time the air which is present in the drive cylinder 7 on the lefthand side of the drive piston 5 will flow out via the air outlet 9.

Since, as mentioned previously, the drive piston 5 together with the control piston 4 and the pump piston 6 constitute a unit, the piston 2A as a whole will be displaced towards the left at the same time as the drive piston 5A. When this happens the control piston 4A will reduce the free space in the control cylinder 18A which causes the hydraulic oil present there to flow via the connecting pipe 20 and the flow regulating valve 21 over to the control cylinder 18B of the lower reciprocating pump. The oil here forces the control piston 4B to be moved in opposite direction to the control piston 4A, the piston 2B being moved at the same time towards the right in FIG. 1. The air enclosed in the drive cylinder 7B flows out through the air inlet 8B communicating with the ambient atmosphere, at the same time as the volume expanding to the left of the drive piston causes air from the environment to be drawn into the cylinder 7 via the air outlet 9.

The movement of the two pistons 2A, 2B is interrupted when the lower drive piston 5B comes to rest against the surface in the drive cylinder 7B serving as a piston stop 27. The piston stop 27B via the connecting pipe 20 also acts upon the piston 2A so that the same stops in a corresponding position. At the same time the valve which connects the air inlet 8A to the source of compressed air is acted upon via e.g. a known limit switch so that the valve is changed over and the air is conducted instead to the air inlet 8B, the air inlet 8A instead being connected to the ambient atmosphere. The movement of the pistons 2 will be changed thereby, and the process is repeated at the required frequency during the working period of the pump.

On reversal of the valve which connects the air inlet 8 to the compressed air source an activation takes place at the same time of the valve 12 controlling the contents so that each time the pistons 2 stop this valve is rotated ⅓rd turn and as a result alternately connects the two reciprocating pumps 1A, 1B to the inlet 15 and to the outlet 16 for the pumped medium respectively. In the present position as shown in FIG. 1 the inlet 15 is connected to the lower reciprocating pump 1B, which means that the pump piston 6A of the upper pump during its displacement towards the right reduces the free volume of the pump cylinder 10A so that contents flow via the contents duct 11 to the outlet 16 of the valve 12 (FIG. 2).

Figure 2:
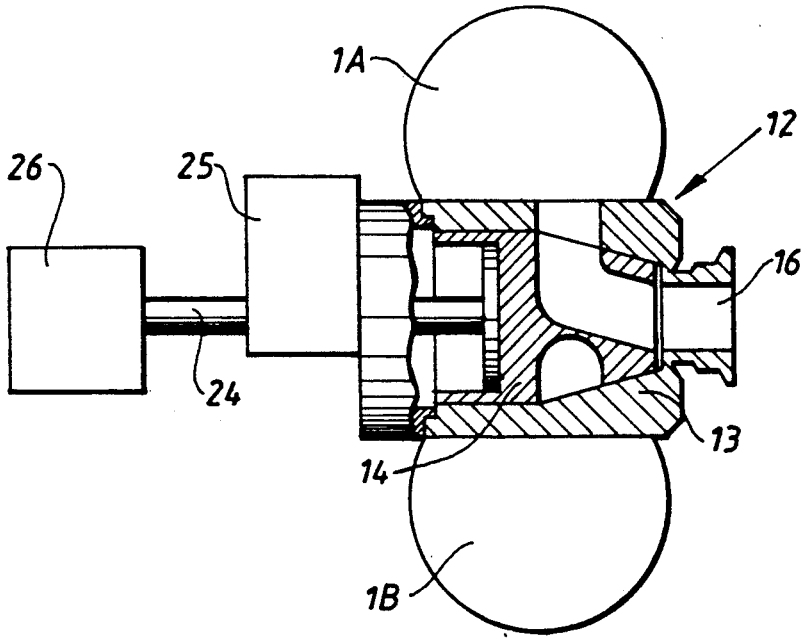
FIG. 2 shows a valve on the unit accordance with the invention partially in section.
Figure 3:
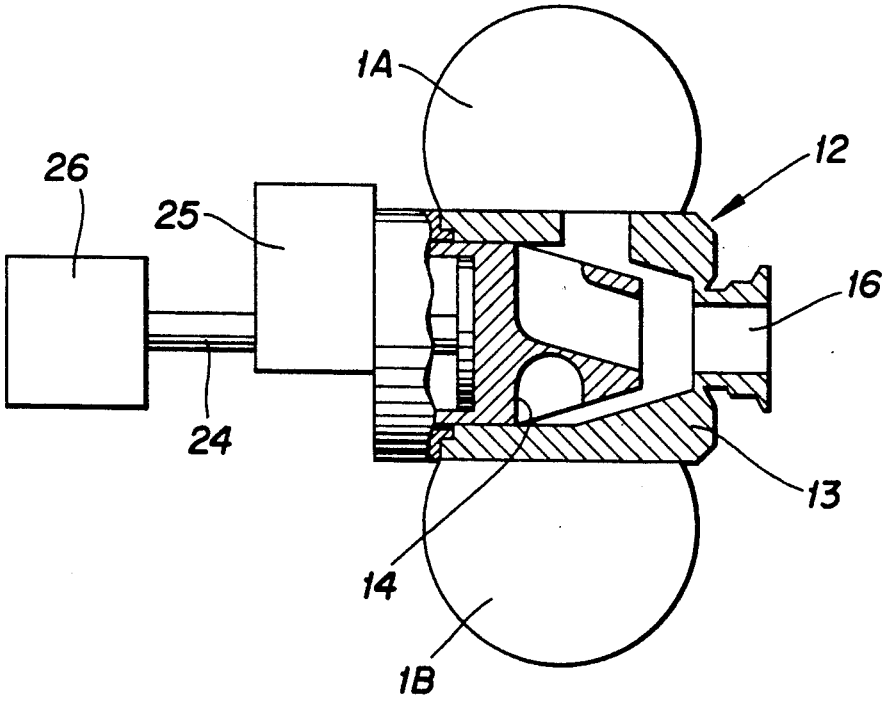
FIG. 3 shows a second position of the valve of FIG. 2.

As is evident from FIG. 2, the conical valve body 14 during operation rests against a corresponding conical seat in the valve casing 13. When the pump unit with the valve casing after completed operation is to be cleaned, the cleaning of the valve 12 is carried out in that the valve body 14 is lifted slightly from its contact with the conical seat in the valve casing 13, which is done by activating the driving device 26, which e.g. may be a pneumatic piston and cylinder unit, and moving the valve body 14 slightly to the left as shown in FIG. 3. As a result all ducts of the valve 12 will be able to comunicate with each other, and cleaning fluid can be made to flow around the valve body and the different ducts with the help of the pump unit so that an accurate and effective cleaning can be provided. At the end of the cleaning process the valve body 14 is returned to the position shown in FIG. 2 and cleaning continues for a time whilst operative handling of the valve 12 takes place until the desired cleaning effect has been achieved.

The pump unit in accordance with the invention is particularly suitable for, and is intended to be used together with, packing machines which fill a prepared packing material with contents in portions and then finish and close the individual packing containers. It is of great importance here that the pump unit should be of such a design that the volume of contents pumped at each working stroke can be adjusted in an accurate and reliable manner. The hydraulic power transmission in the pump unit in accordance with the invention allows great flexibility in this respect. A modification of the volume pumped per working stroke is achieved by varying the amount of hydraulic oil in the control cylinders 18 and the connecting pipe 20, and this is done by opening the valve 22 so that oil from the supply tank 23 through appropriate regulation of the pressure in the same, can be made to flow either to or from the connecting pipe 20 and the control cylinders 18. An increase of the amount of hydraulic oil in the system causes the free volume in the control cylinders 18 to be increased, which means that the two pistons 2A, 2B are forced to the right in FIG. 1 so that the effective length of stroke is reduced. The rear reversal point of the pistons will be displaced to the right whereas the front reversal point determined by the mechanical piston stop 27 remains the same. Owing to the fact that at each working stroke one piston is responsible for the driving and the other piston determines the length of stroke, the pump unit will operate the whole time fully symmetrically, which is a great advantage from a point of view of accuracy of volume. The driving and control arrangements moreover, completely lack movable mechanical parts, e.g. links, lever arms or the like which contributes greatly to enhanced and lasting accuracy of volume also during prolonged operation. The service requirement too is reduced compared with previously known, mechanically driven and controlled pumps.

Not only the volume pumped by each pump stroke, but also the speed of the pump stroke can be adjusted in a simple manner in the pump unit in accordance with the invention. The piston speed is regulated with the help of the flow regulating valve 21, which to a greater or smaller extent throttles the hydraulic oil flow in the connecting pipe 20 so that the desired piston speed is obtained. As a result it becomes possible, e.g. in packing machines, to optimize the flow of contents so that the whole of the time available for filling of an individual packing container is utilized, which means that the flow will be calmer and the contents handled more gently at the same time as frothing and splashing at the outlet aperture into the packing container are avoided. The exact functioning of the double pump unit also makes it possible to even out flow of contents in the common feed line (not shown) so that unnecesary variations in the flow rate are avoided. As a result pressure hammering and shocks in the lines are also prevented.

The drive piston 5, drive cylinder 7 and the compressed air source (not shown) are dimensioned so that the available power is several times greater than the calculated power requirement necessary for pumping the actual contents. Thus the speed of movement of the pump pistons will be wholly determined by the flow regulating valve 21 largely independently of any variation in the pumping resistance of the particular contents.

The simple facility of regulating the length of stroke of the pump pistons by increasing or diminishing the amount of hydraulic oil in the system makes it possible to adjust the length of stroke even during operation.

As a result the pump unit will also be suitable for use together with packing machines of the type which continuously monitor the weight of the packing containers produced, and possibly via a computer transmit regular signals to the pump unit to increase or diminish the amount of contents pumped at each working stroke.

We claim:

1. A pump unit comprising a pair of reciprocating pumps communicating with a common inlet conduit and a common outlet conduit, said pair of reciprocating pumps each having a working piston mounted for reciprocating movement in a pump cylinder between an extended and a retracted position relative to said pump cylinder and a displacement piston and a hydraulic control piston, each of said pumps having a hydraulic control cylinder cooperating with said hydraulic control piston, pipe means interconnecting the hydraulic control cylinders of said pair of pumps to form a closed control system that includes a control fluid for synchronizing of said working pistons for alternating movement between said extended and retracted positions, pneumatic power means for providing a driving fluid for moving each of said displacement pistons alternately toward said retracted position, wherein said pipe means is communicable to an oil supply through a valve such that a predetermined quantity of oil may be introduced into said control system in order to adjust the length of stroke of each working piston, said predetermined quantity being selected according to a desired length of stroke of each working piston and said predetermined quantity of oil remaining substantially unchanged for a particular desired length of stroke during operation of said pump.

2. A pump unit in accordance with claim 1, wherein said connecting pipe means includes a flow control valve means for the control of a flow rate of oil between said control cylinders such that a speed of movement of said working pistons is controlled.

3. A pump unit in accordance with claim 1, wherein each of said pair of reciprocating pumps further include a drive cylinder such that said pump cylinder, drive cylinder and control cylinder of each reciprocating pump are positioned axially in relation to each other.

4. A pump unit in accordance with claim 1, wherein said drive cylinder includes a mechanical piston stop to limit the length of a working stroke of the working piston.

5. A pump unit in accordance with claim 3, wherein said pump cylinder of each of said pair of reciprocating pumps are alternately connectable by a valve to said common inlet and said common outlet.

6. A pump unit in accordance with claim 7, wherein said valve comprises a conical valve body rotatably disposed in a valve casing, said conical valve body being axially displaceable to a cleaning position such that all the ducts present in the valve are communicable with each other through a space between the conical valve body and said valve casing.

7. A pump unit in accordance with claim 1, further comprising a roller diaphragm means for sealing said hydraulic control piston from an inner wall of said hydraulic control cylinder.

* * * * *